US007399967B1

(12) United States Patent
Haynes et al.

(10) Patent No.: US 7,399,967 B1
(45) Date of Patent: Jul. 15, 2008

(54) RAPIDLY FLASHING THERMAL IMAGE BEACON

(76) Inventors: Derek Haynes, 25080 Goldcrest Dr., Bonita Springs, FL (US) 34134; Stuart M. Jenkins, 105 Aldwick Road, Bognor Regis, West Sussex (GB) P021 2NY; Michael Thomas, 36 Seaview Avenue, Peacehaven, East Sussex (GB) BN 10 8SA ( * ) Notice: Subject to any disclaimer, the term of this patent is extended or adjusted under 35 U.S.C. 154(b) by 0 days.

(21) Appl. No.: 11/904,830

(22) Filed: Sep. 28, 2007

(51) Int. Cl.
*G01J 5/00* (2006.01)

(52) U.S. Cl. ..... 250/338.1; 250/495.1; 250/504 R

(58) Field of Classification Search ..... 250/338.1, 250/493.1, 495.1, 504 R
See application file for complete search history.

(56) References Cited

U.S. PATENT DOCUMENTS

| | | | | |
|---|---|---|---|---|
| 2,538,062 | A | 1/1951 | Touvet | |
| 4,249,265 | A | 2/1981 | Coester | |
| 5,001,488 | A | 3/1991 | Joguet | |
| 5,202,783 | A | 4/1993 | Holland et al. | |
| H1488 | H | 9/1995 | Campagnuolo et al. | |
| 5,583,507 | A | 12/1996 | D'Isepo et al. | |
| 5,748,138 | A | 5/1998 | Telle et al. | |
| 5,966,227 | A | 10/1999 | Dubois et al. | |
| 6,548,819 | B1 * | 4/2003 | Lovelady | 250/495.1 |
| 6,720,566 | B2 | 4/2004 | Blandford | |
| 6,897,832 | B2 * | 5/2005 | Essig et al. | 343/912 |
| 7,122,815 | B2 * | 10/2006 | Wood | 250/504 R |
| 2002/0071020 | A1 | 6/2002 | Novak et al. | |
| 2004/0207566 | A1 * | 10/2004 | Essig et al. | 343/878 |
| 2006/0033674 | A1 * | 2/2006 | Essig et al. | 343/912 |

* cited by examiner

*Primary Examiner*—David P. Porta
*Assistant Examiner*—Mark R Gaworecki
(74) *Attorney, Agent, or Firm*—John P. McGonagle

(57) ABSTRACT

A system comprised of a one or more rapidly flashing thermal image beacons, a plurality of sensors, a control subsystem, input means, and a power source. Each beacon being comprised of a precision machined and polished parabolic or elliptical mirror. A resistive heating element is nominally positioned at the mirror focal point. The heating element is mounted on a carriage which can be moved backwards and forwards by a microprocessor-controlled mechanism. The resulting oscillatory action creates a rapidly changing coded flashing thermal image.

8 Claims, 3 Drawing Sheets

RAPIDLY FLASHING THERMAL IMAGE BEACON

CROSS-REFERENCE TO RELATED APPLICATIONS

Applicants claim the priority benefits of U.S. Provisional Patent Application No. 60/605,264, filed Aug. 30, 2004; and U.S. patent application Ser. No. 11/215,225, filed Aug. 29, 2005.

BACKGROUND OF THE INVENTION

This invention relates to thermal identification, and more particularly, to a thermal image identification marker utilizing infrared (IR) energy.

The inability of reconnaissance to determine friend or foe in low light or total darkness is a major failing in battlefield and law enforcement operations. The worst effect is that fratricide (the inadvertent killing of friendly forces by other friendly forces) occurs, and at best is a waste of time and resources attempting to confirm identification. Accurate intelligence allows deployment effort to be maximized and focused.

Present marking and identification systems are limited to either Near IR range (1010 nano meters or less) beacons for use with night vision glasses or thermal panel identification marking equipment. Present thermal panel identification marking equipment is passive and only provides identification by temperature or emissivity differences between adjacent areas and the marking equipment. Passive marking equipment is easily masked by surrounding operations, and is difficult to differentiate from adjacent targets.

There is a need to provide a thermal image, which can change state rapidly so as to provide a clear signal in the heat transmission of the spectrum, normally within the range of 2-12 micrometers.

The thermal image can be achieved by means of a system with a heat source than can be made to rotate and produce a flash of heat at every rotation relative to a point of view with the speed of rotation determining the flash repetition rate. However, this type of system has the disadvantage of being omni-directional and inefficient. The image can also be confused by other nearby heat sources producing a pulsating heat image output.

A thermal image, as produced by a heat source, cannot be made to switch on and off rapidly. There is always a time lag created by heating and cooling cycles. In addition, ambient temperature has an effect. It is difficult to control power input to prevent an additional visual input.

SUMMARY OF THE INVENTION

The present invention overcomes the above disadvantages, minimizing the power required to produce a clear thermal signal and, also provides means by which the thermal image can be made to change state rapidly to produce a signal which can be used for identification purposes. Furthermore, the present invention provides a uniquely coded image with an ability to change its coding. In addition, the marker's thermal image is continuously differentiated from ambient surroundings thereby providing optimum viewing by a thermal imaging device.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
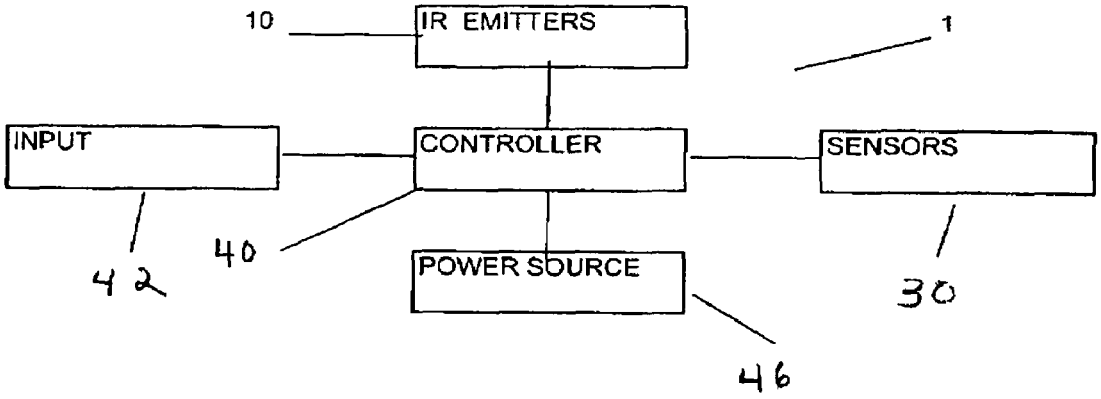
FIG. 1 is a schematic block diagram of the invention.
Figure 2:
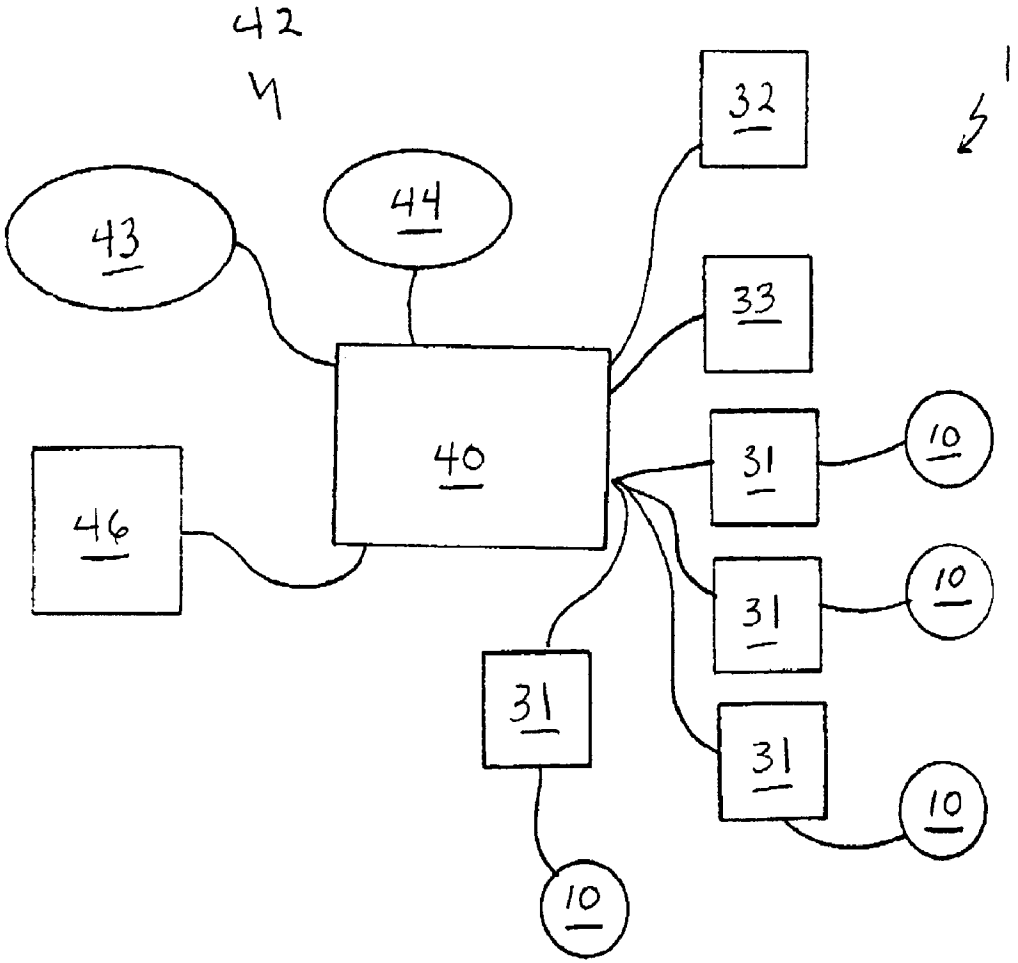
FIG. 2 is a schematic diagram of a thermal IR controller for the present invention.

Referring to the drawings in detail wherein like elements are indicated by like numerals, there is shown a plurality of rapidly flashing thermal image beacons within a thermal image identification marking system 1 constructed according to the principles of the present invention. The system 1 is comprised of a one or more rapidly flashing thermal image beacons 10, a plurality of sensors 30, a control subsystem 40, input means 42, and a power source 46.

Each thermal image beacon 10 of the present invention emits in the infrared (IR) range. The underlying principle of the present invention may be best seen in FIG. 3. In a lamp, such as a car head lamp or simple flashlight, a light source is positioned at the focal point 13 of a parabolic reflector 11, said focal point 13 being length "L" from the reflector 11. Energy rays 14 from the light source at the focal point 13 are reflected off the concave surface 12 of the reflector 11. The energy rays 14 are directed away from the reflector concave surface 12 in a generally parallel arrangement toward a distant spot. If the light source is moved from the reflector focal point 13, i.e., the value of L is changed, the parallelism of the energy rays 14 is diminished and the amount of energy rays arriving at the distant spot is reduced.

Figure 3:
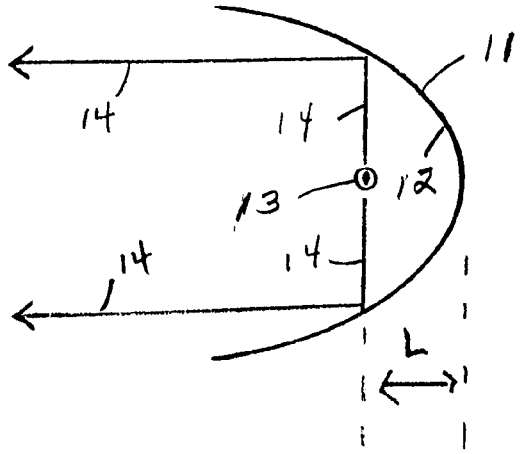
FIG. 3 is a diagrammic view of a parabolic reflector with focal point shown.
Figure 4:
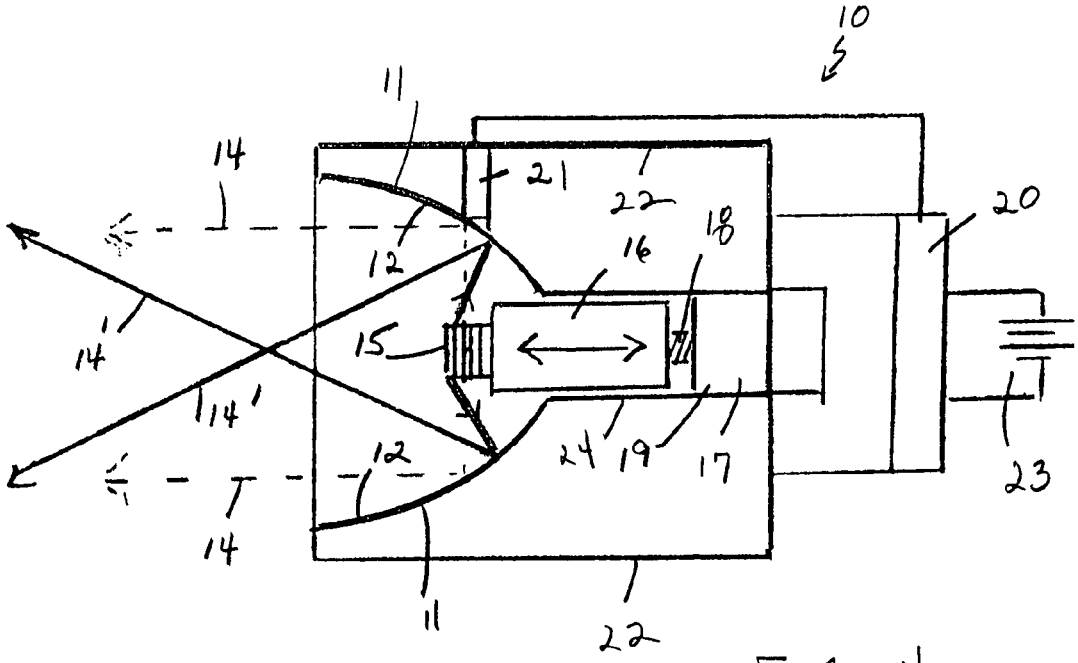
FIG. 4 is a schematic view of a rapidly flashing thermal image emitter

Referring more particularly to FIG. 4, the present invention thermal image emitter 10 provides a precision machined and polished parabolic or elliptical mirror 11. The light source of FIG. 3 is replaced with a black heat source so that only thermal energy is transmitted. In a preferred embodiment the black heat source is a resistive heating element 15 comprised of a resistive wire wound on a ceramic element. The center of the heating element 15 is nominally positioned at the mirror focus point 13. The heating element 15 is mounted on a carriage 16 on a raceway 24, said carriage is adapted to being moved in a backwards and forwards direction along the raceway 24 by a mechanism 17, thereby changing the value of "L" and moving the heating element 15 into and out of the mirror focal point 13. Moving the heating element 15 away from the mirror focal point 13 changes the energy ray configuration from a parallel projection 14 to a non-parallel projection 14'. This changes the intensity of the energy rays reaching a distant point.

The mechanism 17 is comprised of a screw thread 18 driven by a motor 19. The mechanism 17 provides an oscillary action through the carriage 16 to the heating element 15. The mechanism 17 is controlled by a microprocessor system 20 so that the thermal energy being emitted is being moved through the mirror focal point 13 creating a rapidly changing coded flashing thermal image. An infrared sensitive diode detector 21 is positioned in the mirror housing 22. The detector output is connected to the microprocessor system 20. The detector output is part of a negative feedback circuit within the microprocessor system 20, which continuously maintains the infrared output from the heating element 15 to a set level below the red heat level. This has the benefit of concentrating the maximum radiant heat from the mirror while minimizing the heat absorbed by the mirror housing 22. A nominal direct current (DC) from a battery supplies power to the thermal image emitter 10 and its components.

The sensors 30 are grouped into three functions. The first group 31 of sensors measure the thermal IR emission from each emitter 10. The second group 32 of sensors measure thermal IR emission from background or thermal IR surface radiation from the mirror housings 22. The third group 33 of sensors provide a measure of ambient thermal IR emission from sources in close proximity to the IR emitters 10. All sensors 30 provide their measurement data back to the control subsystem 40.

The input means 42 to the control subsystem 40 is comprised generally of a set IR emitter contrast control 43 and an IR mode control 44. The contrast control 43 enables the setting of the thermal IR emission difference between each heating element 15 and background or ambient thermal IR emission levels. The mode control 44 enables the setting of code for the speed of movement of the carriage 16 holding the heating element 15. The mode control 44 also enables setting the mode of display, i.e., flashing, steady, or changing thermal IR emission intensity. The input means 42 may use manual input devices, such as switches and the like. The input means may also use remote controls for setting the contrast controls 43 and mode control 44.

The control subsystem 40 reads the thermal IR emissions from each group of sensors 31, 32, 33. The control subsystem 40 calculates the difference between the emitter emission and background emission, factoring into the calculation the ambient emission. The control subsystem 40 compares the calculated result with the value read from the contrast control 43 as modified by the mode control 44 as appropriate.

The power source 46 will typically be a battery power source, either disposable or rechargeable. Each emitter 10 may have its own power source 23.

The control subsystem 40 may be either digital or analog. Digital control provides a sequential step by step flow with a decision at each stepping point or gate. The parameters set at the gate will determine the path to the next gate. Thus, the path changes based on the measured parameters. Digital circuit speed is so fast as the decisions are executed, that to the mind it appears as a single action. Control is exercised though microcode.

Analog control systems operate at each measurement point simultaneously relative to all of the other points. The whole unit requires several independent analog operations, one for each functional entity. While analog systems are more difficult to change, they are fast and robust. The proportionality within algorithms is always maintained.

It is understood that the above-described embodiment is merely illustrative of the application. The control subsystem 40 may repeat the various sequences as many times as desired. It may also check available power reserve in the power source. The control subsystem 40 may also be used to report failures or lack of available power. Other embodiments may be readily devised by those skilled in the art which will embody the principles of the invention and fall within the spirit and scope thereof.

We claim:

1. A thermal image identification marking system, comprising:

a plurality of thermal image beacons emitting in the infrared (IR) range, each thermal image beacon comprising:

a precision machined and polished parabolic mirror within a housing, said mirror having a concave reflective face with a mirror focal point;

a black heat source transmitting thermal energy, said heat source being nominally positioned at the mirror focal point;

a carriage with said heat source mounted thereon, said carriage being mounted on a raceway; and a mechanism attached to said carriage and adapted to moving said carriage in a backwards and forward direction along said raceway, into and out of said mirror focal point;

a microprocessor system within said housing and attached to said mechanism and providing control commands to said mechanism; and a power source within said housing.

2. A system as recited in claim 1, wherein:

the mechanism is comprised of a screw thread driven by a motor.

3. A system as recited in claim 2, further comprising:

a plurality of sensors functionally divided into three groups, namely a first group adapted to measure a thermal IR emission from each beacon, a second group adapted to measure thermal IR emission from background or thermal IR surface radiation from the mirror housings, and a third group adapted to measure ambient thermal IR emission from sources in close proximity to the IR beacons;

a control subsystem connected to said beacons and said sensors, said control subsystem adapted to read the thermal infrared emissions from each group of sensors; and a power source adapted to provide electrical power to the control subsystem.

4. A system as recited in claim 3, further comprising:

input means to the control subsystem comprised a an IR emitter contrast control and an IR mode control, said contrast control enabling the setting of a thermal IR emission difference between each heating element and background or ambient thermal IR emission levels, said mode control enabling a setting of code for the speed of movement of the carriage holding the heating element, as well as setting the mode of display from a group selected from flashing, steady, or changing thermal IR emission intensity.

5. A system as recited in claim 4, further comprising:

an infrared sensitive diode detector positioned in the mirror housing and connected to the microprocessor system, said diode detector providing output to a negative feedback circuit within the microprocessor system, which continuously maintains the infrared output from the heating element to a level set below the absorption level of the housing.

6. A system as recited in claim 5, wherein:

the parabolic mirror has en elliptical shape.

7. A system as recited in claim 6, wherein:

the black heat source is a resistive heating element comprised of a resistive wire wound on a ceramic element.

8. A system as recited in claim 7, wherein:

all sensors provide their measurement data back to the control subsystem.

* * * * *